US007975506B2

(12) United States Patent
James et al.

(10) Patent No.: US 7,975,506 B2
(45) Date of Patent: Jul. 12, 2011

(54) COAXIAL ECONOMIZER ASSEMBLY AND METHOD

(75) Inventors: Rick T. James, La Crescent, MN (US); Paul F. Haley, Coon Valley, WI (US); Randall L. Janssen, LaCrosse, WI (US); William J. Plzak, La Crescent, MN (US)

(73) Assignee: Trane International, Inc., New York, NY (US)

( * ) Notice: Subject to any disclaimer, the term of this patent is extended or adjusted under 35 U.S.C. 154(b) by 555 days.

(21) Appl. No.: 12/034,551

(22) Filed: Feb. 20, 2008

(65) Prior Publication Data

US 2009/0205361 A1 Aug. 20, 2009

(51) Int. Cl.
*F25B 1/10* (2006.01)

(52) U.S. Cl. ..... 62/510; 62/332; 62/498

(58) Field of Classification Search ..... 62/513, 62/117, 332, 498, 510
See application file for complete search history.

(56) References Cited

U.S. PATENT DOCUMENTS

| | | | |
|---|---|---|---|
| 1,945,071 | A | 1/1934 | Popp |
| 2,285,976 | A | 6/1942 | Huitson |
| 2,465,625 | A | 3/1949 | Aue |
| 2,746,269 | A | 5/1956 | Moody |
| 2,768,511 | A | 10/1956 | Moody |
| 2,770,106 | A | 11/1956 | Moody |
| 2,793,506 | A | 5/1957 | Moody |
| 2,817,475 | A | 12/1957 | Moody |
| 2,827,261 | A | 3/1958 | Parker et al. |
| 2,986,903 | A | 2/1959 | Kocher et al. |
| 3,083,308 | A | 3/1963 | Baumann |
| 3,232,074 | A | 11/1963 | Weller et al. |
| 3,251,539 | A | 5/1966 | Wolfe et al. |
| 3,390,837 | A | 7/1968 | Freeman |
| 3,700,355 | A | 10/1972 | Anderson et al. |
| 3,719,430 | A | 3/1973 | Blair et al. |

(Continued)

FOREIGN PATENT DOCUMENTS

DE 889 091 9/1953

(Continued)

OTHER PUBLICATIONS

International Search Report and Written Opinion for International Patent Application Serial No. PCT/US2009/034620, mailed May 18, 2009.

(Continued)

*Primary Examiner* — Melvin Jones
(74) *Attorney, Agent, or Firm* — McAndrews, Held & Malloy, Ltd.

(57) ABSTRACT

A coaxial economizer for use in a chiller system comprising an inner housing and an outer housing having a common longitudinal axis. The outer housing has an inlet for receiving a fluid from a upstream compressor stage of a multistage compressor and an outlet for conveying a fluid to a downstream compressor stage of a multistage compressor. A flow chamber forms a fluid flow path about the inner housing. A flash chamber is coterminous with the flow chamber and flashes fluid in a liquid state to a gas state. A flow passage between said flash chamber and the flow chamber for conveying a flashed gas from the flash chamber to the flow chamber; wherein the flashed gas conveyed from the flash chamber and the fluid received from the inlet of the outer housing mix along the fluid flow path toward the outlet of the outer housing.

29 Claims, 6 Drawing Sheets

U.S. PATENT DOCUMENTS 3,913,346 A * 10/1975 Moody et al. ..... 62/197
3,941,506 A 3/1976 Robb et al.
4,105,372 A 8/1978 Mishina et al.
4,141,708 A 2/1979 Lavigne, Jr. et al.
4,144,717 A 3/1979 Anderson et al.
4,171,623 A 10/1979 Lavigne, Jr. et al.
4,212,585 A 7/1980 Swarden et al.
4,224,010 A 9/1980 Fijino
4,232,533 A 11/1980 Lundblad et al.
4,240,519 A 12/1980 Wynosky
4,265,589 A 5/1981 Watson et al.
4,271,898 A 6/1981 Freeman
4,307,995 A 12/1981 Catterfeld
4,363,596 A 12/1982 Watson et al.
4,375,939 A 3/1983 Mount et al.
4,377,074 A 3/1983 Jardine
4,379,484 A 4/1983 Lom et al.
4,404,815 A 9/1983 Gilson
4,428,715 A 1/1984 Wiggins
4,449,888 A 5/1984 Balje
4,462,539 A 7/1984 Gilson
4,478,056 A 10/1984 Michaels, Jr.
4,502,837 A 3/1985 Blair et al.
4,509,341 A 4/1985 Zimmern
4,519,539 A 5/1985 Bussjager et al.
4,523,896 A 6/1985 Lhenry et al.
4,573,324 A 3/1986 Tischer et al.
4,686,834 A 8/1987 Haley et al.
4,691,533 A 9/1987 Zimmern
4,734,628 A 3/1988 Bench et al.
4,834,611 A 5/1989 Meng
4,903,497 A 2/1990 Zimmern et al.
4,982,574 A 1/1991 Morris, Jr.
5,016,448 A * 5/1991 Plzak ..... 62/476
5,048,302 A 9/1991 Hagenlocher et al.
5,095,712 A 3/1992 Narreau
5,125,806 A 6/1992 Quick et al.
5,145,317 A 9/1992 Brasz
5,167,130 A 12/1992 Morris, Jr.
5,228,832 A 7/1993 Nishida et al.
5,324,229 A 6/1994 Weisbecker
5,350,039 A 9/1994 Voss et al.
5,355,691 A 10/1994 Sullivan et al.
5,445,496 A 8/1995 Brasz
5,447,037 A 9/1995 Bishop et al.
5,537,830 A 7/1996 Goshaw et al.
5,553,997 A 9/1996 Goshaw et al.
5,555,956 A 9/1996 Voss et al.
5,582,022 A 12/1996 Heinrichs et al.
5,598,718 A 2/1997 Freund et al.
5,669,225 A 9/1997 Beaverson et al.
5,669,756 A 9/1997 Brasz et al.
5,685,696 A 11/1997 Zangeneh et al.
5,692,389 A 12/1997 Lord et al.
5,709,531 A 1/1998 Nishida et al.
5,730,582 A 3/1998 Heitmann
5,795,138 A 8/1998 Gozdawa
5,857,348 A 1/1999 Conry
5,895,204 A 4/1999 Sishtla et al.
5,996,364 A 12/1999 Lifson et al.
6,003,298 A 12/1999 Horner
6,012,897 A 1/2000 Sabnis et al.
6,043,580 A 3/2000 Vogel et al.
6,056,518 A 5/2000 Allen et al.
6,062,028 A 5/2000 Arnold et al.
6,066,898 A 5/2000 Jensen
6,089,839 A 7/2000 Bush et al.
6,139,262 A 10/2000 Ravidranath
6,142,753 A 11/2000 Bush et al.
6,162,033 A 12/2000 Moore, Jr. et al.
6,183,661 B1 2/2001 Makin et al.
6,193,473 B1 2/2001 Mruk et al.
6,202,438 B1 3/2001 Barito
6,279,322 B1 8/2001 Moussa
6,293,119 B1 9/2001 Wenzel
6,293,776 B1 9/2001 Hahn et al.
6,374,631 B1 4/2002 Lifson et al.
6,428,284 B1 8/2002 Vaisman
6,430,959 B1 8/2002 Lifson
6,434,960 B1 8/2002 Rousseau
6,474,087 B1 11/2002 Lifson
6,474,950 B1 11/2002 Waldo
6,505,706 B2 1/2003 Tse
6,532,754 B2 3/2003 Haley et al.
6,540,481 B2 4/2003 Moussa et al.
6,571,576 B1 6/2003 Lifson et al.
6,579,078 B2 6/2003 Hill et al.
6,616,421 B2 9/2003 Mruk et al.
6,679,057 B2 1/2004 Arnold
6,694,750 B1 2/2004 Lifson et al.
6,755,620 B2 6/2004 Nakamura et al.
6,834,501 B1 12/2004 Vrbas et al.
6,872,050 B2 3/2005 Nenstiel
6,874,329 B2 4/2005 Stark et al.
6,883,341 B1 4/2005 Lifson
6,895,781 B2 5/2005 Dobmeier et al.
6,941,769 B1 9/2005 Hill, IV et al.
6,973,797 B2 12/2005 Nemit, Jr.
6,994,518 B2 2/2006 Simon et al.
6,997,686 B2 2/2006 Agrawal et al.
7,000,423 B2 2/2006 Lifson et al.
7,032,387 B2 4/2006 Germain et al.
7,044,716 B2 5/2006 Fabry
7,059,151 B2 6/2006 Taras et al.
7,083,379 B2 8/2006 Nikpour et al.
7,114,349 B2 10/2006 Lifson et al.
7,164,242 B2 1/2007 Federman et al.
7,189,062 B2 3/2007 Fukizawa et al.
7,208,891 B2 4/2007 Jadric et al.
RE39,597 E 5/2007 Rousseau
7,228,707 B2 6/2007 Lifson et al.
7,240,515 B2 7/2007 Conry
2002/0106278 A1 8/2002 Koga
2004/0179947 A1 9/2004 Agrawal et al.
2007/0065300 A1 3/2007 Mariani et al.

FOREIGN PATENT DOCUMENTS

DE 10060114 6/2001
EP 0 297 691 1/1989
EP 0 855 562 7/1998
EP 1 217 219 6/2002
EP 1 416 123 5/2004
EP 1 429 032 6/2004
EP 1 862 749 12/2007

OTHER PUBLICATIONS

Manczyk, H., "Refrigeration Chiller Performance Analysis at Various Loads." Online: http://www.energy.rochester.edu/efficiency/chilleranalysis.pdf. Apr. 2, 2003, pp. 1-6. XP002528251.

Yasuo Fukushima et al. "New Oilless Era for Process Compressors." Hitachi Review, vol. 41, No. 6, Jan. 1, 1993. XP 000369880.

Notice of Allowance and Fee(s) Due mailed Aug. 23, 2010, for U.S. Appl. No. 12/034,608, filed Feb. 20, 2008.

Non-final Office Action mailed Aug. 26, 2010, for U.S. Appl. No. 12/034,607, filed Feb. 20, 2008.

* cited by examiner

COAXIAL ECONOMIZER ASSEMBLY AND METHOD

BACKGROUND OF THE INVENTION

The present invention generally relates to an economizer for flash cooling a refrigerant liquid, and specifically with an economizer arranged coaxially with a condenser or other structure, e.g. an evaporator, for use in a refrigeration system having at least two stages of compression.

Refrigeration systems typically incorporate a refrigeration loop to provide chilled water for cooling a designated building space. A typical refrigeration loop includes a compressor to compress refrigerant gas, a condenser to condense the compressed refrigerant to a liquid, and an evaporator that utilizes the liquid refrigerant to cool water. The chilled water is then piped to the space to be cooled.

One such refrigeration or air conditioning system uses at least one centrifugal compressor and is referred to as a centrifugal chiller. Centrifugal compression involves the purely rotational motion of only a few mechanical parts. A single centrifugal compressor chiller, sometimes called a simplex chiller, typically range in size from 100 to above 2,000 tons of refrigeration. Typically, the reliability of centrifugal chillers is high, and the maintenance requirements are low.

Centrifugal chillers consume significant energy resources in commercial and other high cooling and/or heating demand facilities. Such chillers can have operating lives of upwards of thirty years or more in some cases.

Centrifugal chillers provide certain advantages and efficiencies when used in a building, city district (e.g. multiple buildings) or college campus, for example. Such chillers are useful over a wide range of temperature applications including Middle East conditions. At lower refrigeration capacities, screw, scroll or reciprocating-type compressors are most often used in, for example, water-based chiller applications.

One component of existing chillers is an economizer. The economizer improves the operating efficiency of the system.

An economizer is typically utilized between the condenser and the evaporator of a refrigeration system to cool refrigerant liquid below the temperature at which it leaves the condenser. Flash cooling is achieved by the evaporation of part of the refrigerant liquid as it flows from the condenser through nozzles, orifices, or other pressure reducing means into a chamber which is lower in pressure. The flashing refrigerant cools the remaining liquid by absorbing heat as it vaporizes. Upon separation from the cooled liquid, the refrigerant vapor, or flash gas, is conveyed to the inlet of a compressor stage operating at intermediate pressure. The cooled refrigerant liquid flows from the economizer to an evaporator, where it is vaporized in heat exchange relationship with another fluid, e.g., water, to satisfy a cooling load. Refrigerant vapor leaving the evaporator is typically compressed in two or more stages of compression. Prior economizers have been designed as separate units, distinct from the condenser, compressor and other structures common to chiller systems.

Prior chiller designs also typically connect the first stage discharge of a compressor to a second stage compressor and include complicated casting and piping arrangements. These designs are sometimes called two-stage, in-line designs.

Essentially, these in-line designs have a series of continuous castings that allow the discharge gas leaving a first stage compressor to be delivered into the inlet of the second stage compressor. The impeller of the first stage compressor imposes a great deal of tangential velocity to the fluid being compressed. This fluid with a tangential velocity is called swirling flow. As the fluid flows through the diffuser of the first stage compressor, it passes through a 180° U-bend. A set of blades in the return channel bend are typically used in an attempt to direct the fluid flow in an axial direction at the inlet to the second stage compressor. This swirling fluid flow is combined with the flash gas flow from the economizer to essentially inter-cool the swirling gas of the first stage compression. In practice, the mixing of the two flows is not as thorough as desired and predominately occurs far enough down the fluid flow path, e.g. in the impellers of the second stage, that only a modest efficiency improvement is gained.

BRIEF SUMMARY OF THE INVENTION

According to a preferred embodiment of the present invention, a coaxial economizer for use in a chiller system comprises an inner housing and an outer housing having a common longitudinal axis. The outer housing has an inlet for receiving a fluid from an upstream compressor stage of a multistage compressor and an outlet for conveying a fluid to a downstream compressor stage of a multistage compressor. A flow chamber forms a fluid flow path about the inner housing. A flash chamber for flashing fluid in a liquid state to a gas state. A flow passage between said flash chamber and the flow chamber conveys a flashed gas from the flash chamber to the flow chamber. The flashed gas conveyed from the flash chamber and the fluid received from the inlet of the outer housing mixes along the fluid flow path toward the outlet of the outer housing.

In yet another preferred embodiment of the present invention, a method of flowing fluid through a coaxial economizer in chiller system comprises the steps of: receiving a fluid from an upstream compressor stage of a multistage compressor into a coaxial economizer; flashing a liquid to gas within a flash chamber of the coaxial economizer; passing the gas within the flash chamber through a flow passage to the flow chamber of the coaxial economizer; and mixing and flowing the gas conveyed from the flash chamber and the fluid received from the inlet of the outer housing along the fluid flow path to the outlet of the coaxial economizer. The coaxial economizer of this method comprises: an inner housing and an outer housing having a common longitudinal axis; said outer housing having an inlet for receiving a fluid from the upstream compressor stage and an outlet for conveying a fluid to a downstream compressor stage; a flow chamber forming a fluid flow path about the inner housing; a flash chamber for flashing fluid in a liquid state to a gas state; and a flow passage between said flash chamber and the flow chamber for conveying a flashed gas from the flash chamber to the flow chamber; wherein the flashed gas conveyed from the flash chamber and the fluid received from the inlet of the outer housing mix along the fluid flow path toward the outlet of the outer housing.

Embodiments of the coaxial economizer eliminates the traditional in-line design, combines multiple functions into one integrated system, improves fluid mixing of the inter-cooled gas prior to entry of the second stage and improves fluid flow dynamics (e.g. swirl reduction) through the system, which, in turn, improves chiller performance. The coaxial economizer is operable over a wide capacity range, and provides improved efficiency in a compact size.

Additional advantages and features of the invention will become more apparent from the description of a preferred embodiment of the present invention and the claims which follow.

BRIEF DESCRIPTION OF THE SEVERAL VIEWS OF THE DRAWINGS

The following figures include like numerals indicating like features where possible.

DETAILED DESCRIPTION OF A PREFERRED EMBODIMENT

Figure 1:
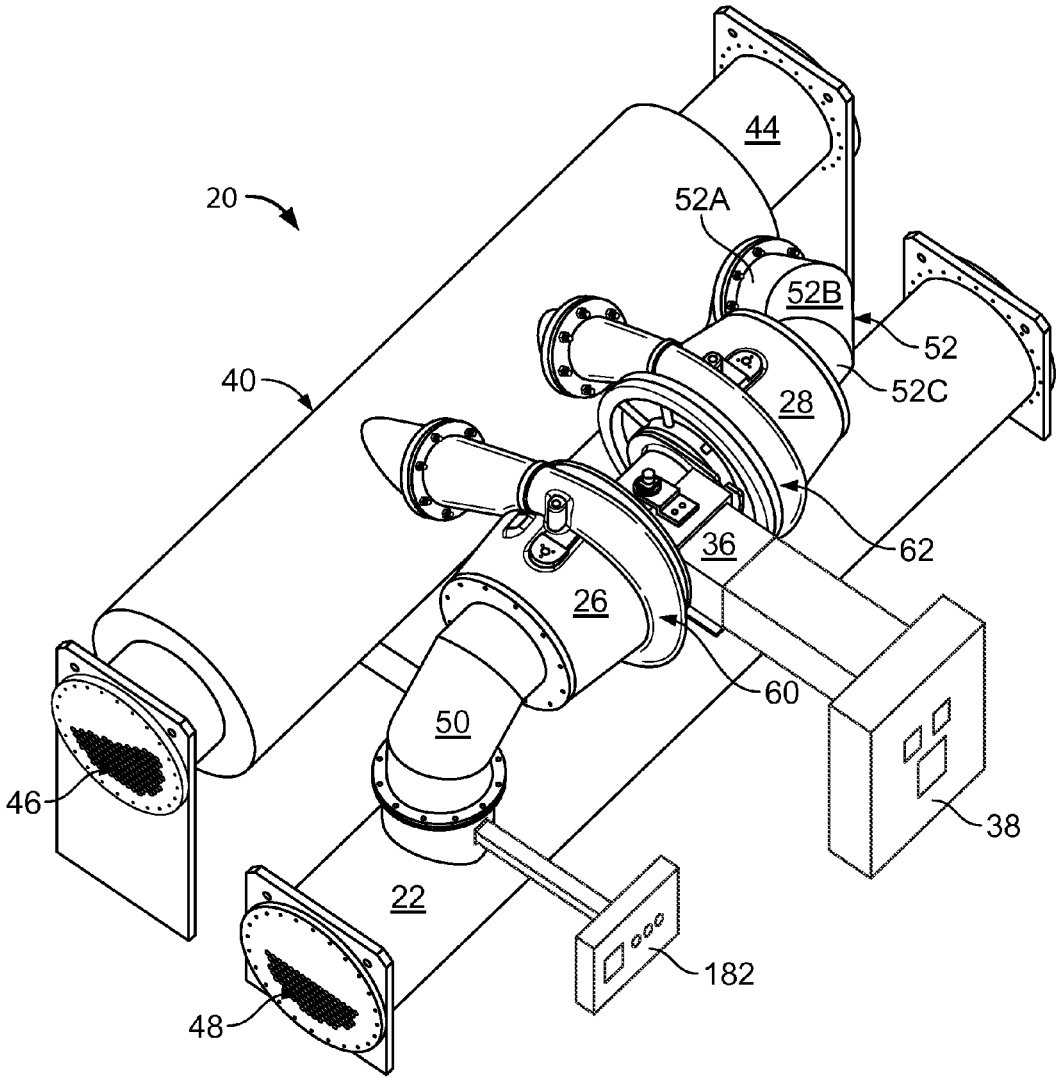
FIG. 1 illustrates a perspective view of a chiller system and the various components according to an embodiment of the present invention.
Figure 2:
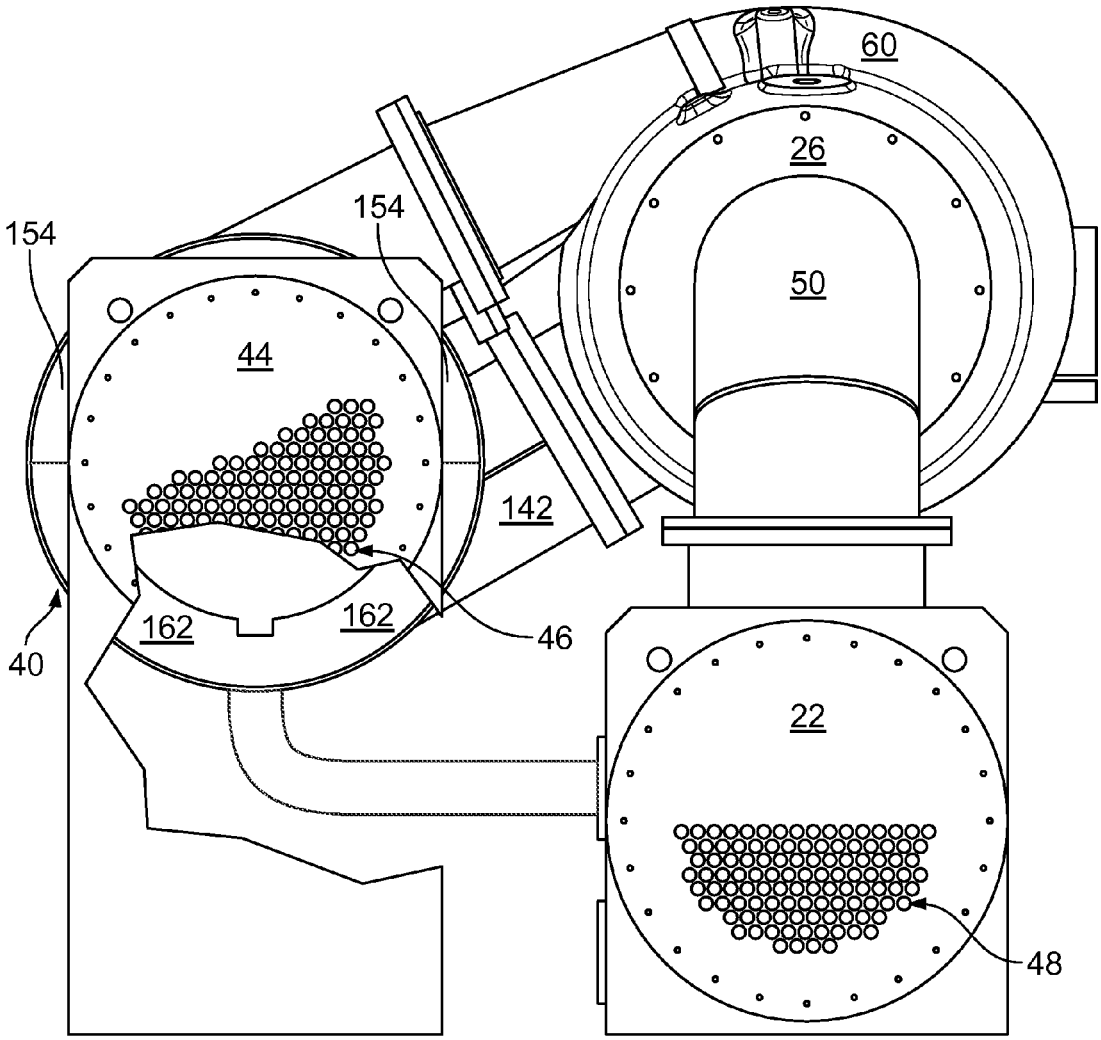
FIG. 2 illustrates an end, cut away view of a chiller system showing tubing arrangements for the condenser and evaporator according to an embodiment of the present invention.
Figure 3:
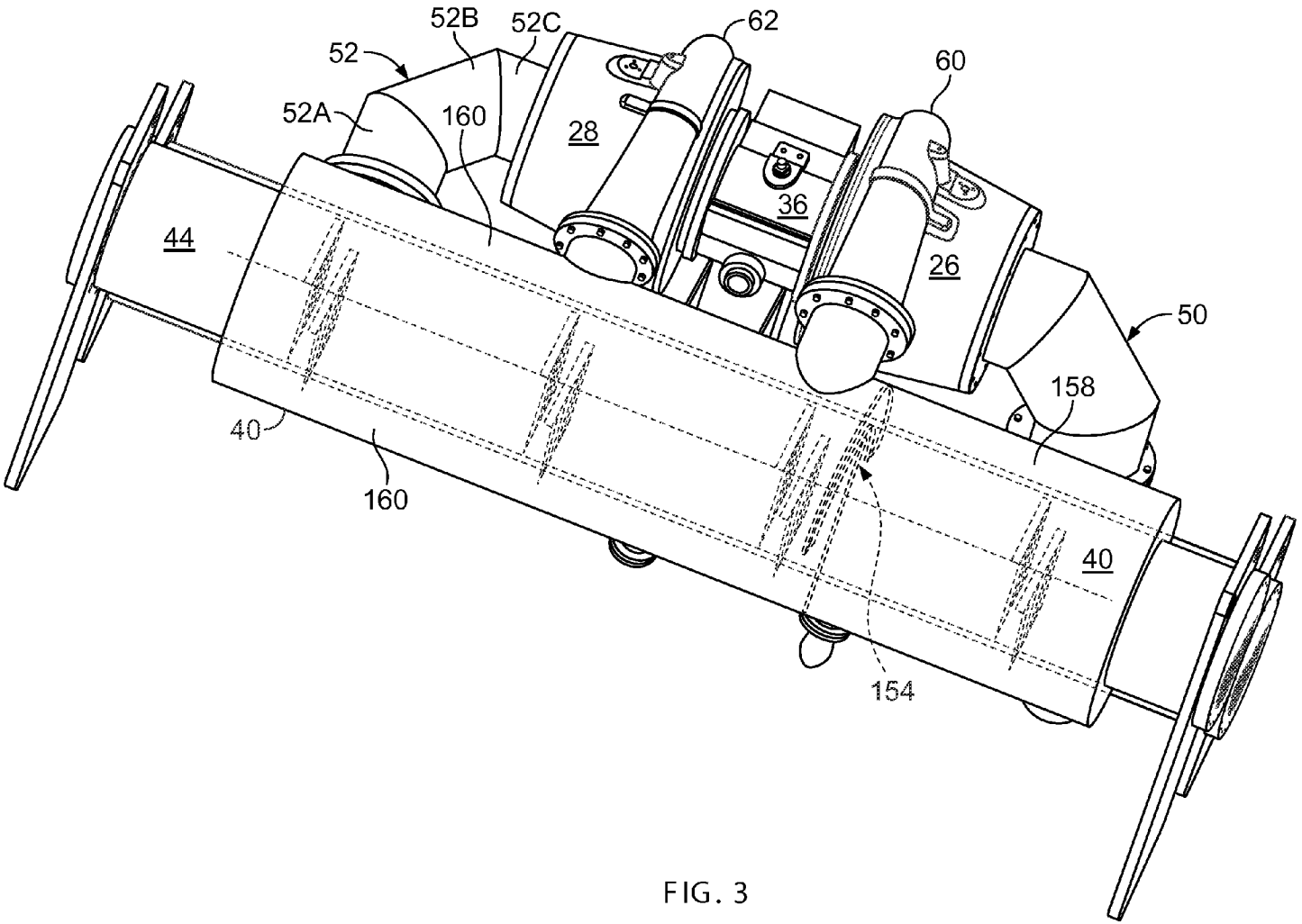
FIG. 3 illustrates another perspective view of a chiller system according to an embodiment of the present invention.

Referring to FIGS. 1-3 of the drawings, a chiller or chiller system 20 for a refrigeration system. A single centrifugal chiller system and the basic components of chiller 20 are illustrated in FIGS. 1-3. The chiller 20 includes many other conventional features not depicted for simplicity of the drawings. In addition, as a preface to the detailed description, it should be noted that, as used in this specification and the appended claims, the singular forms "a," "an," and "the" include plural referents, unless the context clearly dictates otherwise.

In the embodiment depicted, chiller 20 is comprised of an evaporator 22, multi-stage compressor 24 having a non-final stage compressor 26 and a final stage compressor 28 driven by a variable speed, direct drive permanent magnet motor 36, and a coaxial economizer 40 with a condenser 44. The chiller 20 is directed to relatively large tonnage centrifugal chillers in the range of about 250 to 2000 tons or larger.

In a preferred embodiment, the compressor stage nomenclature indicates that there are multiple distinct stages of gas compression within the chiller's compressor portion. While a multi-stage compressor 24 is described below as a two-stage configuration in a preferred embodiment, persons of ordinary skill in this art will readily understand that embodiments and features of this invention are contemplated to include and apply to, not only two-stage compressors/chillers, but to single stage and other multiple stage compressors/chillers, whether in series or in parallel.

Referring to FIGS. 1-2, for example, preferred evaporator 22 is shown as a shell and tube type. Such evaporators can be of the flooded type. The evaporator 22 may be of other known types and can be arranged as a single evaporator or multiple evaporators in series or parallel, e.g. connecting a separate evaporator to each compressor. As explained further below, the evaporator 22 may also be arranged coaxially with an economizer 42. The evaporator 22 can be fabricated from carbon steel and/or other suitable material, including copper alloy heat transfer tubing.

A refrigerant in the evaporator 22 performs a cooling function. In the evaporator 22, a heat exchange process occurs, where liquid refrigerant changes state by evaporating into a vapor. This change of state, and any superheating of the refrigerant vapor, causes a cooling effect that cools liquid (typically water) passing through the evaporator tubing 48 in the evaporator 22. The evaporator tubing 48 contained in the evaporator 22 can be of various diameters and thicknesses and comprised typically of copper alloy. The tubes may be replaceable, are mechanically expanded into tube sheets, and externally finned seamless tubing.

The chilled or heated water is pumped from the evaporator 22 to an air handling unit (not shown). Air from the space that is being temperature conditioned is drawn across coils in the air handling unit that contains, in the case of air conditioning, chilled water. The drawn-in air is cooled. The cool air is then forced through the air conditioned space, which cools the space.

Also, during the heat exchange process occurring in the evaporator 22, the refrigerant vaporizes and is directed as a lower pressure (relative to the stage discharge) gas through a non-final stage suction inlet pipe 50 to the non-final stage compressor 26. Non-final stage suction inlet pipe 50 can be, for example, a continuous elbow or a multi-piece elbow.

A three-piece elbow is depicted in an embodiment of non-final stage suction inlet pipe 50 in FIGS. 1-3, for example. The inside diameter of the non-final stage suction inlet pipe 50 is sized such that it minimizes the risk of liquid refrigerant droplets being drawn into the non-final stage compressor 26. For example, the inside diameter of the non-final stage suction inlet pipe 50 can be sized based on, among things, a limit velocity of 60 feet per second for a target mass flow rate, the refrigerant temperature and a three-piece elbow configuration. In the case of the multi-piece non-final stage suction inlet pipe 50, the lengths of each pipe piece can also be sized for a shorter exit section to, for example, minimize corner vortex development.

Figure 6:
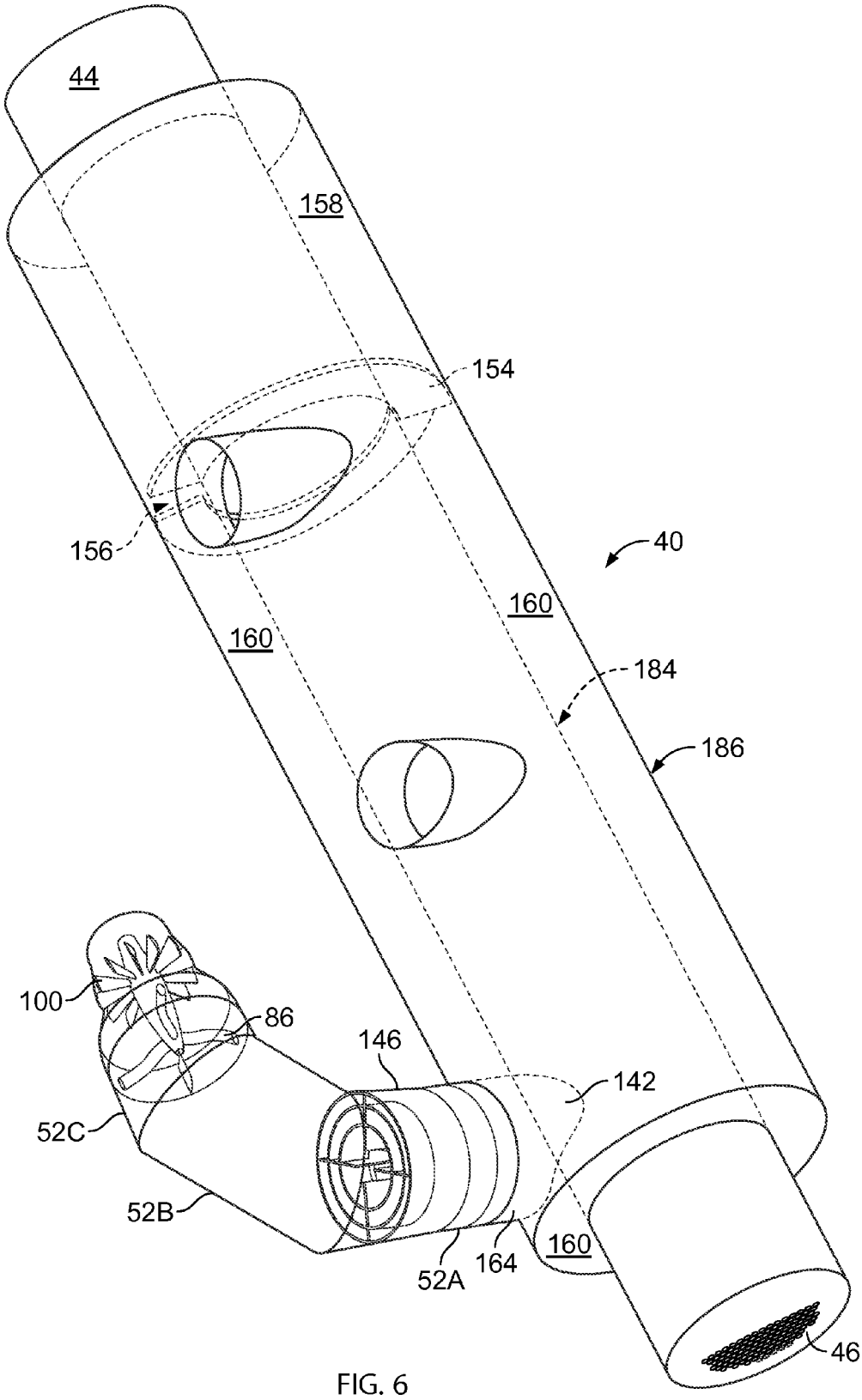
FIG. 6 illustrates a view of a swirl reducer and vortex fence positioned in a first leg of a three leg suction pipe between a conformal draft pipe attached to a coaxial economizer arrangement upstream of a final stage compressor according to an embodiment of the present invention.

To condition the fluid flow distribution delivered to the non-final stage compressor 26 from the non-final stage suction inlet pipe 50, a swirl reducer or deswirler 146, as illustrated in FIG. 6 and described further below, can be optionally incorporated into the non-final stage suction inlet pipe 50. The refrigerant gas passes through the non-final stage suction inlet pipe 50 as it is drawn by the multi-stage centrifugal compressor 24, and specifically the non-final stage centrifugal compressor 26.

Generally, a multi-stage compressor compresses refrigerant gas or other vaporized fluid in stages by the rotation of one or more impellers during operation of the chiller's closed refrigeration circuit. This rotation accelerates the fluid and in turn, increases the kinetic energy of the fluid. Thereby, the compressor raises the pressure of fluid, such as refrigerant, from an evaporating pressure to a condensing pressure. This arrangement provides an active means of absorbing heat from a lower temperature environment and rejecting that heat to a higher temperature environment.

Details of the structure, function and operation of a preferred compressor assembly, which may include a mixed flow impeller and/or an inlet flow conditioning assembly, are disclosed in co-pending Application Ser. Nos. 12/034,608, 12/034,607 and 12/034,594, commonly assigned to the assignee of the present invention and are expressly incorporated herein by reference. A brief discussion of a preferred compressor assembly follows; however, other compressor assemblies may be used with embodiments of the present invention.

Figure 4:
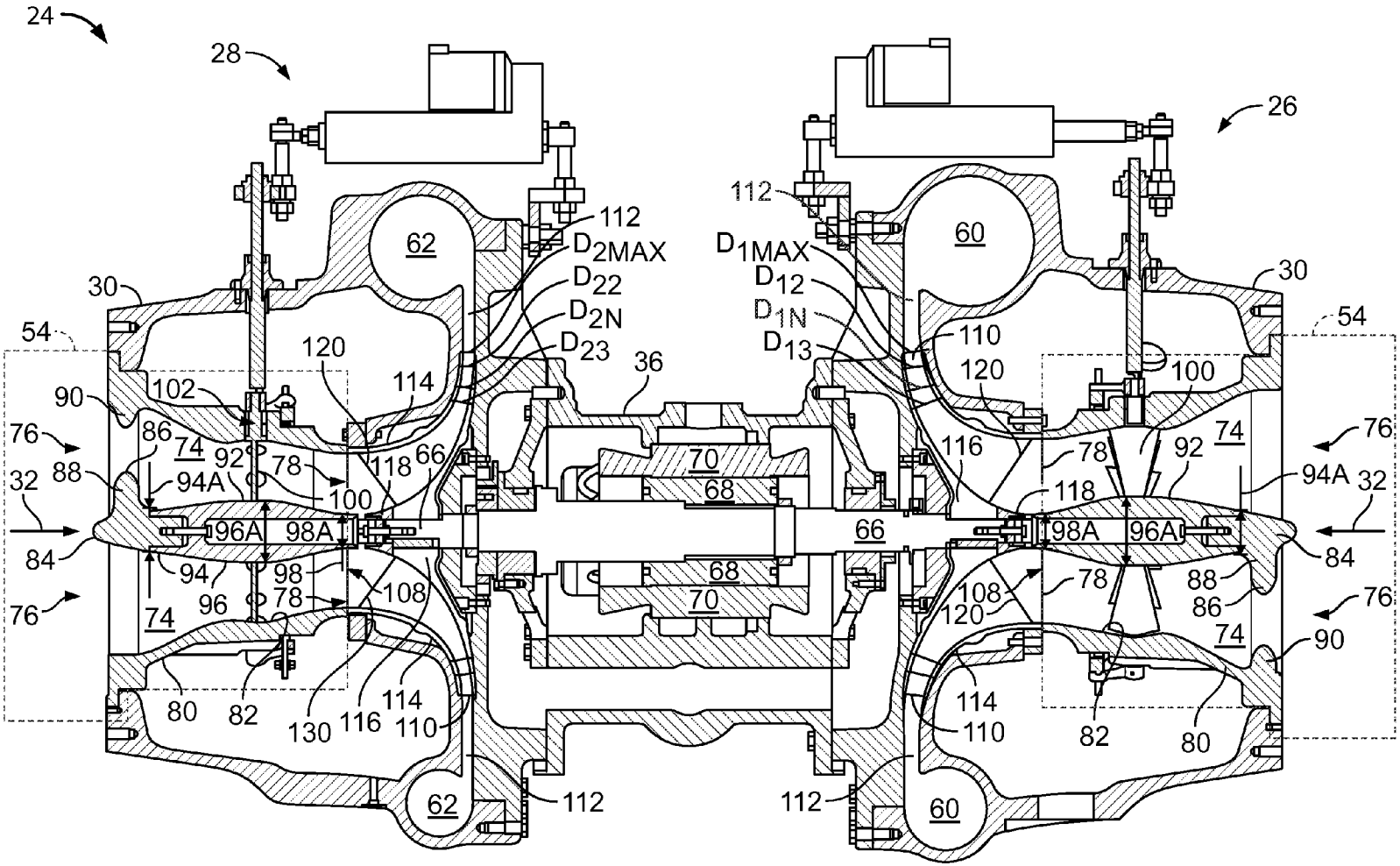
FIG. 4 illustrates a cross-sectional view of a multi-stage centrifugal compressor for a chiller system according to an embodiment of the present invention.

Referring now to FIG. 4, the compressor 24 is typically an electric motor driven unit. A variable speed drive system drives the multi-stage compressor. The variable speed drive system comprises a permanent magnet motor 36 located preferably in between the non-final stage compressor 26 and the final stage compressor 28 and a variable speed drive 38 having power electronics for low voltage (less than about 600 volts), 50 Hz and 60 Hz applications. The variable speed drive system efficiency, line input to motor shaft output, preferably can achieve a minimum of about 95 percent over the system operating range.

While conventional types of motors can be used with and benefit from embodiments of the present invention, a preferred motor is a permanent magnet motor 36. Permanent magnet motor 36 can increase system efficiencies over other motor types.

A preferred motor 36 comprises a direct drive, variable speed, hermetic, permanent magnet motor. The speed of the motor 36 can be controlled by varying the frequency of the electric power that is supplied to the motor 36. The horsepower of preferred motor 36 can vary in the range of about 125 to about 2500 horsepower.

The permanent magnet motor 36 is under the control of a variable speed drive 38. The permanent magnet motor 38 of an embodiment is compact, efficient, reliable, and relatively quieter than conventional motors. As the physical size of the compressor assembly is reduced, the compressor motor used must be scaled in size to fully realize the benefits of improved fluid flow paths and compressor element shape and size. Motor 36 is reduced in volume by approximately 30 to 50 percent or more when compared to conventional existing designs for compressor assemblies that employ induction motors and have refrigeration capacities in excess of 250-tons. The resulting size reduction of embodiments of the present invention provides a greater opportunity for efficiency, reliability, and quiet operation through use of less material and smaller dimensions than can be achieved through more conventional practices.

Typically, an AC power source (not shown) will supply multiphase voltage and frequency to the variable speed drive 38. The AC voltage or line voltage delivered to the variable speed drive 38 will typically have nominal values of 200V, 230V, 380V, 415V, 480V, or 600V at a line frequency of 50 Hz or 60 Hz depending on the AC power source.

The permanent magnet motor 36 comprises a rotor 68 and a stator 70. The stator 70 consists of wire coils formed around laminated steel poles, which convert variable speed drive applied currents into a rotating magnetic field. The stator 70 is mounted in a fixed position in the compressor assembly and surrounds the rotor 68, enveloping the rotor with the rotating magnetic field. The rotor 68 is the rotating component of the motor 36 and consists of a steel structure with permanent magnets, which provide a magnetic field that interacts with the rotating stator magnetic field to produce rotor torque. The rotor 68 may have a plurality of magnets and may comprise magnets buried within the rotor steel structure or be mounted at the rotor steel structure surface. The rotor 68 surface mount magnets are secured with a low loss filament, metal retaining sleeve or by other means to the rotor steel support. The performance and size of the permanent magnet motor 36 is due in part to the use of high energy density permanent magnets.

Permanent magnets produced using high energy density magnetic materials, at least 20 MGOe (Mega Gauss Oersted), produce a strong, more intense magnetic field than conventional materials. With a rotor that has a stronger magnetic field, greater torques can be produced, and the resulting motor can produce a greater horsepower output per unit volume than a conventional motor, including induction motors. By way of comparison, the torque per unit volume of permanent magnet motor 36 is at least about 75 percent higher than the torque per unit volume of induction motors used in refrigeration chillers of comparable refrigeration capacity. The result is a smaller sized motor to meet the required horsepower for a specific compressor assembly.

Further manufacturing, performance, and operating advantages and disadvantages can be realized with the number and placement of permanent magnets in the rotor 68. For example, surface mounted magnets can be used to realize greater motor efficiencies due to the absence of magnetic losses in intervening material, ease of manufacture in the creation of precise magnetic fields, and effective use of rotor fields to produce responsive rotor torque. Likewise, buried magnets can be used to realize a simpler manufactured assembly and to control the starting and operating rotor torque reactions to load variations.

The bearings, such as rolling element bearings (REB) or hydrodynamic journal bearings, can be oil lubricated. Other types of bearings can be oil-free systems. A special class of bearing which is refrigerant lubricated is a foil bearing and another uses REB with ceramic balls. Each bearing type has advantages and disadvantages that should be apparent to those of skill in the art. Any bearing type that is suitable of sustaining rotational speeds in the range of about 2,000 to about 20,000 RPM may be employed.

The rotor 68 and stator 70 end turn losses for the permanent magnet motor 36 are very low compared to some conventional motors, including induction motors. The motor 36 therefore may be cooled by means of the system refrigerant. With liquid refrigerant only needing to contact the stator 70 outside diameter, the motor cooling feed ring, typically used in induction motor stators, can be eliminated. Alternatively, refrigerant may be metered to the outside surface of the stator 70 and to the end turns of the stator 70 to provide cooling.

The variable speed drive 38 typically will comprise an electrical power converter comprising a line rectifier and line electrical current harmonic reducer, power circuits and control circuits (such circuits further comprising all communication and control logic, including electronic power switching circuits). The variable speed drive 38 will respond, for example, to signals received from a microprocessor (also not shown) associated with the chiller control panel 182 to increase or decrease the speed of the motor by changing the frequency of the current supplied to motor 36. Cooling of motor 36 and/or the variable speed drive 38, or portions thereof, may be by using a refrigerant circulated within the chiller system 20 or by other conventional cooling means. Utilizing motor 36 and variable speed drive 38, the non-final stage compressor 26 and a final stage compressor 28 typically have efficient capacities in the range of about 250-tons to about 2,000-tons or more, with a full load speed range from approximately 2,000 to above about 20,000 RPM.

With continued reference to FIG. 4 and turning to the compressor structure, the structure and function of the non-final or upstream stage compressor 26, final or downstream stage compressor 28 and any intermediate stage compressor (not shown) are substantially the same, if not identical, and therefore are designated similarly as illustrated in the FIG. 4, for example. Differences, however, between the compressor stages exist in a preferred embodiment and will be discussed below. Features and differences not discussed should be readily apparent to one of ordinary skill in the art.

Preferred non-final stage compressor 26 has a compressor housing 30 having both a compressor inlet 32 and a compressor outlet 34. The non-final stage compressor 26 further comprises an inlet flow conditioning assembly 54, a non-final stage impeller 56, a diffuser 112 and a non-final stage external volute 60.

The non-final stage compressor 26 can have one or more rotatable impellers 56 for compressing a fluid, such as refrigerant. Such refrigerant can be in liquid, gas or multiple phases and may include R-123 refrigerant. Other refrigerants, such as R-134a, R-245fa, R-141b and others, and refrigerant mixtures are contemplated. Further, the present invention contemplates use of azeotropes, zeotropes and/or a mixture or blend thereof that have been and are being developed as alternatives to commonly used contemplated refrigerants.

By the use of motor 36 and variable speed drive 38, multistage compressor 24 can be operated at lower speeds when the flow or head requirements on the chiller system do not require the operation of the compressor at maximum capacity, and operated at higher speeds when there is an increased demand for chiller capacity. That is, the speed of motor 36 can be varied to match changing system requirements which results in approximately 30 percent more efficient system operation compared to a compressor without a variable speed drive. By running compressor 24 at lower speeds when the load or head on the chiller is not high or at its maximum, sufficient refrigeration effect can be provided to cool the reduced heat load in a manner which saves energy, making the chiller more economical from a cost-to-run standpoint and making chiller operation extremely efficient as compared to chillers which are incapable of such load matching.

Referring still to FIGS. 1-4, refrigerant is drawn from the non-final stage suction piping 50 to an integrated inlet flow conditioning assembly 54 of the non-final stage compressor 26. The integrated inlet flow conditioning assembly 54 comprises an inlet flow conditioning housing 72 that forms a flow conditioning channel 74 with flow conditioning channel inlet 76 and flow conditioning channel outlet 78. The channel 74 is defined, in part, by a shroud wall 80 having an inside shroud side surface 82, a flow conditioning nose 84, a strut 86, a flow conditioning body 92 and a plurality of inlet guide blades/vanes 100. These structures, which may be complimented with swirl reducer 146, cooperate to produce fluid flow characteristics that are delivered into the vanes 100, such that less turning of the vanes 100 is required to create the target swirl distribution for efficient operation in impellers 56, 58.

The drawing of FIG. 4 also depicts a double-ended shaft 66 that has a non-final stage impeller 56 mounted on one end of the shaft 66 and a final stage impeller 58 on the other end of the shaft 66. The double-ended shaft configuration of this embodiment allows for two or more stages of compression. The impeller shaft 66 is typically dynamically balanced for vibration reduced operation, preferably and predominantly vibration free operation.

Different arrangements and locations of the impellers 56, 58; shaft 66 and motor 36 should be apparent to one of ordinary skill in the art as being within the scope of the invention. It should be also understood that in this embodiment the structure and function of the impeller 56, impeller 58 and any other impellers added to the compressor 24 are substantially the same, if not identical. However, impeller 56, impeller 58 and any other impellers may have to provide different flow characteristics impeller to impeller.

In a preferred embodiment, fluid is delivered from the impellers 56, 58 and diffusers 112 to a non-final stage external volute 60 and a final stage external volute 62, respectively for each stage. The volutes 60, 62, illustrated in FIG. 1-4, are external. The volutes 60, 62 have a centroid radius that is greater than the centroid radius at the exit of the diffuser 112. Volutes 60, 62 have a curved funnel shape and increase in area to a discharge port 64 for each stage, respectively. Volutes that lie off the meridional diffuser centerline are sometimes called overhung.

The external volutes 60, 62 of this embodiment replace the conventional return channel design and are comprised of two portions—the scroll portion and the discharge conic portion. Use of volutes 60, 62 lowers losses as compared to return channels at part load and have about the same or less losses at full load. As the area of the cross-section increases, the fluid in the scroll portion of the volutes 60, 62 is at about a constant static pressure so it results in a distortion free boundary condition at the diffuser exit. The discharge conic increases pressure when it exchanges kinetic energy through the area increase.

In the case of the non-final stage compressor 26 of this embodiment, fluid is delivered from the external volute 60 to a coaxial economizer 40. In the case of the final stage compressor 28 of this embodiment, the fluid is delivered from the external volute 62 to a condenser 44 (which may be arranged coaxially with an economizer).

Turning now to the coaxial economizer 40, the coaxial economizer 40 has an economizer 42 arranged coaxially with a condenser 44. Applicants refer to this arrangement as an exemplary coaxial economizer 40. The coaxial economizer 40 combines multiple functions into one integrated system and further increases system efficiencies. Coaxial is used in the common sense where one structure (e.g. economizer 42) has a coincident axis with at least one other structure (e.g. the condenser 44 or evaporator 22). A discussion of a preferred coaxial economizer 40 follows.

By the use of coaxial economizer 40, additional efficiencies are added to the compression process that takes place in chiller 20 and the overall efficiency of chiller 20 is increased. The coaxial economizer 40 combines multiple functions into one integrated system and further increases system efficiencies.

Other coaxial economizer arrangements within the scope of this invention should be apparent. For example, while economizer 42 surrounds and is coaxial with condenser 44 in a preferred embodiment, it will be understood by those skilled in the art that it may be advantageous in certain circumstances for economizer 42 to surround evaporator 22. An example of such a circumstance is one in which, due to the particular application or use of chiller 20, it is desired that evaporator 22, when surrounded by economizer 42, acts, in effect, as a heat sink to provide additional interstage cooling to the refrigerant gas flowing through economizer 40, prospectively resulting in an increase in the overall efficiency of the refrigeration cycle within chiller 20.

As illustrated in FIGS. 2 and 6, the coaxial economizer comprises an inner housing 184 and an outer housing 186 having a common longitudinal axis. The outer housing 186 has an inlet for receiving a fluid from a stage of a multistage compressor and an outlet for conveying a fluid to a stage of a multistage compressor.

The economizer 40 preferably has two chambers: a flow chamber forming a fluid flow path about the inner housing and a economizer flash chamber 158 for flashing fluid in a liquid state to a gas state. In one embodiment, the economizer 40 has two chambers isolated by two spiraling baffles 154. The number of baffles 154 may vary. The baffles 154 isolate an economizer flash chamber 158 and a superheat chamber 160.

The economizer flash chamber 158 contains two phases of fluid, a gas and a liquid. The condenser 44 supplies liquid to the economizer flash chamber 158.

The spiraling baffles 154 depicted in FIG. 6 form a flow passage 156 between said flash chamber 158 and the flow chamber 160 for conveying flashed gas from the flash chamber 158 to the flow chamber 160. The preferred arrangement enables the flashed gas conveyed from the flash chamber 158 and the fluid received from the inlet of the outer housing 186 to mix along the fluid flow path toward the outlet of the outer housing 186. In one embodiment, the spiraling baffles 154 depicted in FIG. 6 form a flow passage 156 defined by two injection slots. The flow passage 156 can take other forms, such as a plurality of perforations in the baffle 154.

During operation, gas in the economizer flash chamber 158 is drawn out through the injection slots 156 into the superheat chamber 160. The spiraling baffles 154 are oriented so that the fluid exits through the two injection slots 156 of the spiraling baffles 154. The fluid exits in approximately the same tangential directions as the flow discharged from the non-final stage compressor 26. The face areas of the flow passage 156 are sized to produce approximately matching velocities and flow rates in the flow passage 156 relative to the adjacent local mixing superheat chamber 160 (suction pipe side). This requires a different injection face area of the flow passage 156 based on the location of the tangential discharge conic flow, where a smaller gap results closest to the shortest path length distance, and a larger gap at the furthest path length distance. Intermediate superheat chambers 160 and flash chambers may be provided, for example, when more than two stages of compression are used.

The economizer flash chamber 158 introduces approximately 10 percent (which can be more or less) of the total fluid flow through the chiller 20. The economizer flash chamber 158 introduces lower temperature economizer flash gas with superheated gas from the discharge conic of the non-final stage compressor 26. The coaxial economizer 42 arrangement generously mixes the inherent local swirl coming out of the economizer flash chamber 158 and the global swirl introduced by the tangential discharge of the non-final stage compressor 26—discharge which, in one embodiment, is typically over the top of the outside diameter condenser 44 and the inside diameter of coaxially arranged economizer 42.

The liquid in chamber 162 is delivered to the evaporator 22. This liquid in the bottom portion of the economizer flash chamber 158 is sealed from the superheat chamber 160. Sealing of liquid chamber 162 can be sealed by welding the baffle 154 to the outer housing of the coaxially arranged economizer 42. Leakage is minimized between other mating surfaces to less than about 5 percent.

In addition to combining multiple functions into one integrated system, the coaxial economizer 40 produces a compact chiller 20 arrangement. The arrangement is also advantageous because the flashed fluid from the economizer flash chamber 158 better mixes with the flow from the non-final stage compressor 26 than existing economizer systems, where there is a tendency for the flashed economizer gas not to mix prior to entering a final stage compressor 28. In addition, the coaxial economizer 40 dissipates local conic discharge swirl as the mixed out superheated gas proceeds circumferentially to the final stage compressor 28 to the tangential final stage suction inlet 52. Although some global swirl does exist at the entrance to the final stage suction pipe 52, the coaxial economizer 40 reduces the fluid swirl by about 80 percent compared to the non-final stage compressor 26 conic discharge swirl velocity. Remaining global swirl can be optionally reduced by adding a swirl reducer or deswirler 146 in the final stage suction pipe 52.

Turning to FIG. 6, a vortex fence 164 may be added to control strong localized corner vortices in a quadrant of the conformal draft pipe 142. The location of the vortex fence 164 is on the opposite side on the most tangential pick up point of the coaxially arranged economizer 42 and the conformal draft pipe 142. The vortex fence 164 is preferably formed by a sheet metal skirt projected from the inner diameter of the conformal draft pipe 142 (no more than a half pipe or 180 degrees is required) and bounds a surface between the outside diameter of the condenser 44 and inner diameter of the coaxially arranged economizer 42. The vortex fence 164 eliminates or minimizes corner vortex development in the region of the entrance of the draft pipe 142. The use of a vortex fence 164 may not be required where a spiral draft pipe 142 wraps around a greater angular distance before feeding the inlet flow conditioning assembly 54.

Figure 5:
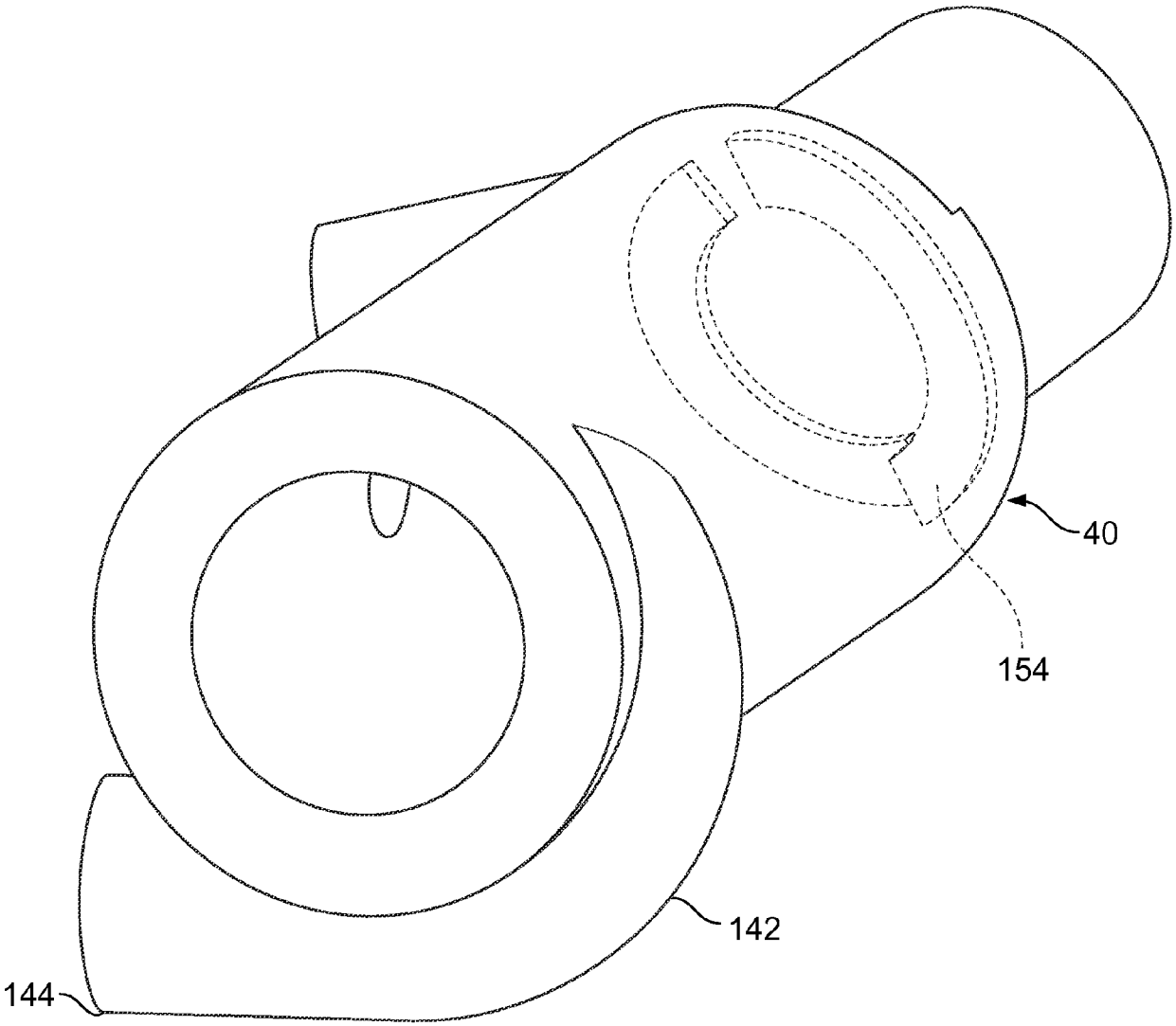
FIG. 5 illustrates a perspective view of a conformal draft pipe attached to a coaxial economizer arrangement according to an embodiment of the present invention.

From the coaxial economizer 40 of this embodiment, the refrigerant vapor is drawn by final stage impeller 58 of the final stage compressor 28 and is delivered into a conformal draft pipe 142. Referring to FIG. 5, the conformal draft pipe 142 has a total pipe wrap angle of about 180 degrees, which is depicted as starting from where the draft pipe 142 changes from constant area to where it has zero area. The draft pipe exit 144 of the draft pipe 142 has an outside diameter surface that lies in the same plane as the inner diameter of the condenser 44 of the coaxially arranged economizer 42. Conformal draft pipe 142 achieves improved fluid flow distribution, distortion control and swirl control entering a later stage of compression.

Conformal draft pipe 142 can have multiple legs. Use of multiple legs may be less costly to produce than a conformal draft pipe 142 as depicted in FIG. 5. Use of such a configuration has a total pipe wrap angle that is less than 90 degrees, which starts from about where projected pipe changes from constant area to a much reduced area. A draft pipe 142 with multiple legs achieves about 80 percent of the idealized pipe results for distribution, distortion and swirl control.

Referring still to FIG. 6, fluid is delivered from the draft pipe 142 to a final stage suction pipe 52. The final stage suction pipe 52 is similarly, if not identically, configured to the inlet suction pipe 50. As discussed, the suction pipe 50, 52 can be a three-piece elbow. For example, the illustrated final suction pipe 52 has a first leg 52A, section leg 52B, and a third leg 52C.

Optionally, a swirl reducer or deswirler 146 may be positioned within the final stage suction pipe 52. Details of the structure, function and operation of a preferred swirl reducer 146 are disclosed in co-pending Application Ser. Nos. 12/034,608, 12/034,607 and 12/034,594, commonly assigned to the assignee of the present invention and are expressly incorporated herein by reference. A brief discussion of a preferred swirl reducer 146 follows; however, other swirl reducers may be used with embodiments of the present invention.

The swirl reducer 146 may be positioned in the first leg 52A, second leg 52B, or third leg 52C. Referring to FIG. 6, an embodiment of the swirl reducer 146 has a flow conduit 148 and radial blades 150 connected to the flow conduit 148 and the suction pipe 50, 52. The number of flow conduits 148 and radial blades 150 varies depending on design flow conditions. The flow conduit 148 and radial blade 150, cambered or uncambered, form a plurality of flow chambers 152. The swirl reducer 146 is positioned such that the flow chambers 152 have a center coincident with the suction pipe 50, 52. The swirl reducer 146 swirling upstream flow to substantially axial flow downstream of the swirl reducer 146. The flow conduits 148 preferably have two concentric flow conduits 148 and are selected to achieve equal areas and minimize blockage.

The number of chambers 152 is set by the amount of swirl control desired. More chambers and more blades produce better deswirl control at the expense of higher blockage. In one embodiment, there are four radial blades 150 that are sized and shaped to turn the tangential velocity component to axial without separation and provide minimum blockage.

The location of the swirl reducer 146 may be located elsewhere in the suction pipe 52 depending on the design flow conditions. As indicated above, the swirl reducer 146 may be placed in the non-final stage suction pipe 50 or final stage suction pipe 52, in both said pipes, or may not be used at all.

Also, the outside wall of the swirl reducer 146 can coincide with the outside wall of the suction pipe 52 and be attached. Alternatively, the one or more flow conduits 148 and one or more radial blades 150 can be attached to an outside wall and inserted as a complete unit into suction pipe 50, 52.

As illustrated in FIG. 6, a portion of radial blade 150 extends upstream beyond the flow conduit 148. The total chord length of the radial blade 150 is set in one embodiment to approximately one-half of the diameter of the suction pipe 50, 52. The radial blade 150 has a camber roll. The camber roll of the radial blade 150 rolls into the first about forty percent of the radial blade 150. The camber roll can vary. The camber line radius of curvature of the radial blade 150 is set to match flow incidence. One may increase incidence tolerance by rolling a leading edge circle across the span of the radial blade 150.

The radial uncambered portion of the radial blade 150 (no geometric turning) is trapped by the concentric flow conduits 148 at about sixty percent of the chord length of the radial blade 150. The refrigerant exits the swirl reducer 146 positioned in the final stage suction pipe 52 and is further drawn downstream by the final stage compressor 28. The fluid is compressed by the final stage compressor 28 (similar to the compression by the non-final stage compressor 26) and discharged through the external volute 62 out of a final stage compressor outlet 34 into condenser 44. Referring to FIG. 2, the conic discharge from the final stage compressor 28 enters into the condenser approximately tangentially to the condenser tube bundles 46.

Turning now to the condenser 44 illustrated in FIGS. 1-3 and 6, condenser 44 can be of the shell and tube type, and is typically cooled by a liquid. The liquid, which is typically city water, passes to and from a cooling tower and exits the condenser 44 after having been heated in a heat exchange relationship with the hot, compressed system refrigerant, which was directed out of the compressor assembly 24 into the condenser 44 in a gaseous state. The condenser 44 may be one or more separate condenser units. Preferably, condenser 44 may be a part of the coaxial economizer 40.

The heat extracted from the refrigerant is either directly exhausted to the atmosphere by means of an air cooled condenser, or indirectly exhausted to the atmosphere by heat exchange with another water loop and a cooling tower. The pressurized liquid refrigerant passes from the condenser 44 through an expansion device such as an orifice (not shown) to reduce the pressure of the refrigerant liquid.

The heat exchange process occurring within condenser 44 causes the relatively hot, compressed refrigerant gas delivered there to condense and pool as a relatively much cooler liquid in the bottom of the condenser 44. The condensed refrigerant is then directed out of condenser 44, through discharge piping, to a metering device (not shown) which, in a preferred embodiment, is a fixed orifice. That refrigerant, in its passage through metering device, is reduced in pressure and is still further cooled by the process of expansion and is next delivered, primarily in liquid form, through piping back into evaporator 22 or economizer 42, for example.

Metering devices, such as orifice systems, can be implemented in ways well known in the art. Such metering devices can maintain the correct pressure differentials between the condenser 42, economizer 42 and evaporator 22 of the entire range of loading.

In addition, operation of the compressors, and the chiller system generally, is controlled by, for example, a microcomputer control panel 182 in connection with sensors located within the chiller system that allows for the reliable operation of the chiller, including display of chiller operating conditions. Other controls may be linked to the microcomputer control panel, such as: compressor controls; system supervisory controls that can be coupled with other controls to improve efficiency; soft motor starter controls; controls for regulating guide vanes 100 and/or controls to avoid system fluid surge; control circuitry for the motor or variable speed drive; and other sensors/controls are contemplated as should be understood. It should be apparent that software may be provided in connection with operation of the variable speed drive and other components of the chiller system 20, for example.

It will be readily apparent to one of ordinary skill in the art that the centrifugal chiller disclosed can be readily implemented in other contexts at varying scales. Use of various motor types, drive mechanisms, and configurations with embodiments of this invention should be readily apparent to those of ordinary skill in the art. For example, embodiments of multi-stage compressor 24 can be of the direct drive or gear drive type typically employing an induction motor.

Chiller systems can also be connected and operated in series or in parallel (not shown). For example, four chillers could be connected to operate at twenty five percent capacity depending on building load and other typical operational parameters.

The patentable scope of the invention is defined by the claims as described by the above description. While particular features, embodiments, and applications of the present invention have been shown and described, including the best mode, other features, embodiments or applications may be understood by one of ordinary skill in the art to also be within the scope of this invention. It is therefore contemplated that the claims will cover such other features, embodiments or applications and incorporates those features which come within the spirit and scope of the invention.

We claim:

1. A coaxial economizer for use in a chiller system comprising:

a. an inner housing and an outer housing having a common longitudinal axis; said outer housing having an inlet for receiving a fluid from an upstream compressor stage of a multistage compressor and an outlet for conveying a fluid to a downstream compressor stage of a multistage compressor;

b. a flow chamber forming a fluid flow path about the inner housing;

c. a flash chamber for flashing fluid in a liquid state to a gas state; and d. a flow passage between said flash chamber and the flow chamber for conveying a flashed gas from the flash chamber to the flow chamber; wherein the flashed gas conveyed from the flash chamber and the fluid received from the inlet of the outer housing mix along the fluid flow path toward the outlet of the outer housing.

2. The coaxial economizer of claim 1 wherein the fluid is a refrigerant selected from R-123, R-134a or R-22 in a liquid, gas, or multiple phase.

3. The coaxial economizer of claim 1 wherein the fluid is an azeotrope, a zeotrope or a mixture or blend thereof in a liquid, gas, or multiple phase.

4. The coaxial economizer of claim 1 wherein the inner housing is formed by a condenser and the outer housing is formed by an economizer.

5. The coaxial economizer of claim 1 wherein the inner housing is defined by an evaporator and the outer housing is defined by an economizer.

6. The coaxial economizer of claim 1 wherein a slot in a baffle defines the flow passage; said baffle being positioned between the flow chamber and the flash chamber and defining a coterminous boundary between the flash chamber and the flow chamber.

7. The coaxial economizer of claim 6 wherein the baffle seals a liquid in the flash chamber from flowing into the flow chamber.

8. The coaxial economizer of claim 1 wherein at least two slots formed by at least two spiraling baffles form the flow passage; said spiraling baffles are positioned between the flow chamber and the flash chamber and define a coterminous boundary between the flash chamber and the flow chamber.

9. The coaxial economizer of claim 6 wherein the flow passage comprises a plurality of perforations in a baffle for conveying gas from the flash chamber to the flow chamber.

10. The coaxial economizer of claim 1 wherein the flow passage is configured to deliver the fluid at approximately the same direction as the fluid flow received at the inlet of the outer housing.

11. The coaxial economizer of claim 1 wherein the inner housing of the coaxial economizer comprises a condenser.

12. The coaxial economizer of claim 11 wherein the condenser is configured to receive fluid from the upstream compressor stage; wherein the upstream stage compressor is a non-final stage compressor and the downstream stage is a final stage compressor.

13. The coaxial economizer of claim 12 wherein the final stage compressor is configured to deliver fluid into the condenser approximately tangentially to a condenser tube bundle.

14. The coaxial economizer of claim 1 wherein the inner housing of the coaxial economizer comprises an evaporator.

15. The coaxial economizer of claim 14 wherein the evaporator is configured to discharge fluid to an upstream compressor stage; wherein the upstream compressor stage is a non-final stage compressor and the downstream compressor stage is a final stage compressor.

16. The coaxial economizer of claim 1 wherein the inner housing and the outer housing are of generally elongated shape.

17. The coaxial economizer of claim 1 wherein the inner housing and the outer housing are each cylindrically shaped.

18. The coaxial economizer of claim 1 wherein the outlet of the outer housing comprises a conformal draft pipe; the conformal draft pipe forming a circumferential flow path around the outer housing of the coaxial economizer.

19. The coaxial economizer of claim 18 wherein the conformal draft pipe has a wrap angle around the coaxial economizer of about 180 degrees.

20. The coaxial economizer of claim 1 wherein a vortex fence is located adjacent to the outlet of the outer housing for reducing localized swirl of the fluid flowing through the flow chamber in a region about the outlet of the outer housing.

21. The coaxial economizer of claim 20 wherein said vortex fence forms a skirt projected from the outlet of the outer housing between the outside diameter of the inner housing and inner diameter of the outer housing.

22. A method of flowing fluid through a coaxial economizer in a chiller system comprising the steps of:

a. receiving a fluid from an upstream compressor stage of a multistage compressor into a coaxial economizer; said coaxial economizer comprising:
   i. an inner housing and an outer housing having a common longitudinal axis; said outer housing having an inlet for receiving a fluid from the upstream compressor stage and an outlet for conveying a fluid to a downstream compressor stage of a multistage compressor;
   ii. a flow chamber forming a fluid flow path about the inner housing;
   iii. a flash chamber for flashing fluid in a liquid state to a gas state; and
   iv. a flow passage between said flash chamber and the flow chamber for conveying a flashed gas from the flash chamber to the flow chamber; wherein the flashed gas conveyed from the flash chamber and the fluid received from the inlet of the outer housing mix along the fluid flow path toward the outlet of the outer housing;
b. flashing a liquid to a gas within the flash chamber;
c. passing the gas within the flash chamber through the flow passage to the flow chamber; and
d. mixing and flowing the gas conveyed from the flash chamber and the fluid received from the inlet of the outer housing along the fluid flow path to the outlet of the coaxial economizer.

23. The method of claim 22 wherein the fluid is a refrigerant selected from R-123, R-134a or R-22 in a liquid, gas, or multiple phase.

24. The method of claim 22 wherein the fluid is an azeotrope, a zeotrope or a mixture or blend thereof in a liquid, gas, or multiple phase.

25. The method of claim 22 wherein the inner housing is formed by a condenser and the outer housing is formed by an economizer.

26. The method of claim 25 further comprising the step of delivering a liquid refrigerant from the condenser to the flash chamber.

27. The method of claim 22 further comprising the step of drawing the gas though the outlet of the outer housing through a conformal draft pipe to the downstream compressor stage, wherein the downstream compressor stage is a final stage compressor.

28. The method of claim 22 wherein the inner housing is formed by an evaporator and the outer housing is formed by an economizer.

29. The method of claim 22 wherein the passing step further comprises passing the gas through the flow passage such that the flow passage is configured to deliver the fluid at approximately the same tangential direction as the fluid received at the inlet of the outer housing.

* * * * *